United States Patent [19]

Nagashiro et al.

[11] 4,020,191

[45] Apr. 26, 1977

[54] METHOD FOR FORMING FLAT DISPLAY PANEL PHOSPHOR DOTS

[75] Inventors: Waichi Nagashiro; Tadao Okabe; Atsushi Sumioka, all of Hachioji; Mitsuru Oikawa, Tokyo, all of Japan

[73] Assignee: Hitachi, Ltd., Japan

[22] Filed: Sept. 10, 1975

[21] Appl. No.: 611,985

[30] Foreign Application Priority Data

Sept. 13, 1974 Japan ..... 49-104989

[52] U.S. Cl. ..... 427/12; 427/54; 427/68; 427/226; 427/272; 427/282; 427/376 A; 427/380

[51] Int. Cl.[2] ..... B05D 3/06

[58] Field of Search ..... 427/64, 68, 282, 272, 427/54, 12, 226, 376 A, 380

[56] References Cited

UNITED STATES PATENTS

| | | | |
|---|---|---|---|
| 2,827,390 | 3/1958 | Garrigus | 427/64 |
| 3,243,625 | 3/1966 | Levine et al. | 427/68 |
| 3,406,068 | 10/1968 | Law | 427/68 |
| 3,481,733 | 12/1969 | Evans | 427/68 |
| 3,569,761 | 3/1971 | Lange | 427/68 |
| 3,639,138 | 2/1972 | Shortes | 427/68 |
| 3,677,791 | 7/1972 | Palac | 427/54 |
| 3,764,366 | 10/1973 | Ninagawa et al. | 427/68 |
| 3,927,224 | 12/1975 | Levene | 427/64 |

*Primary Examiner*—Cameron K. Weiffenbach
*Attorney, Agent, or Firm*—Craig & Antonelli

[57] ABSTRACT

A method for forming flat display panel phosphor dots is disclosed wherein a conventional printing method or procedure is used in combination with an optical method.

The paste film containing the phosphor, photoresist and powdered glass is coated on the surface of the dielectric layer, e.g. lead glass layer by means of the printing method. The paste layer is irradiated by a ultraviolet light through a mask, and after the development of the paste layer has been completed, the remaining hardened portions of the paste layer are subjected to a heat treatment. In this way, phosphor dots having a desired shape can be formed very firmly and very exactly at certain predetermined portions on said dielectric layer.

13 Claims, 10 Drawing Figures

METHOD FOR FORMING FLAT DISPLAY PANEL PHOSPHOR DOTS

BACKGROUND OF THE INVENTION

1. Field of the Invention

The present invention relates to a method of forming the phosphor dots of a flat display panel. More particularly, it relates to a method of coating phosphor on predetermined portions of a plurality of the discharge spaces, which are provided on the same plane so as to act as the display elements of the flat display panel.

2. Description of the Prior Art

Recently, many kinds of display panels have been investigated in order to find a novel display method which has decided advantages over the color picture tube.

Among them, a plasma display panel or other flat display panels which utilize discharge phenomena are regarded as providing the most favorable display methods. Also, for improving the luminous characteristics of these flat display panels, or for providing a novel color display panel, the phosphor materials are coated on predetermined portions of the discharge spaces.

However, these flat display panels, such as a plasma display panel, have a very complicated structure, and each display element or discharge space provided on these display panels is extremely small. For this reason, if the conventional photoetching method employing the photoresist and a mask are applied, the whole surface of the panel is coated with the photoresist layer containing the phosphor. Also, it is very difficult to remove such phosphor from the portions on which no phosphor is to be coated.

For this reason, in fabricating the display panel, the phosphor has been coated by means of a known and conventional printing method employing silk screen. However, the display elements or discharge spaces provided on the display panel are so small that it is difficult to coat the phosphor only on the predetermined portions in the discharge spaces by means of the printing method. Furthermore, if the phosphor is coated not only on the predetermined portions but also on the other portions, the discharge characteristics of the display panel become worse, and consequently favorable luminescence cannot be maintained.

SUMMARY OF THE INVENTION

The object of the present invention is, therefore, to provide a method of coating the predetermined portions of the display panel with very high precision, and thereby solve problems encountered by the conventional printing method employing silk screen.

In order to attain the above object, the present invention employs the conventional printing method employing silk screen in combination with an optical method and uses paste materials containing the phosphor, photoresist and powdered glass, in order to provide the desired phosphor patterns or dots only on the predetermined portions in a very exact manner.

DETAILED DESCRIPTION

Figure 1:
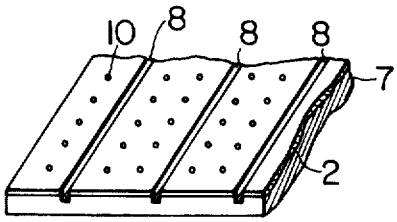
FIGS. 1, 2, 3, 4 and 5 show the sequence of steps in the process of providing flat display panel phosphor dots in accordance with the present invention.

The method of forming flat display panel phosphor dots according to the present invention, comprises the following procedure.

Using the said conventional printing method or procedure a paste layer containing a photoresist material such as KMER, KTFR (trade name, containing azido sensitizer gum), the phosphor and glass powder is coated on a plurality of the desired areas of the dielectric layer. Each area covers at least the predetermined portions of the dielectric layer on which the phosphor dots or patterns are to be formed, and is somewhat broader than said predetermined portions.

A mask having beam apertures is placed on the opposite side of the dielectric layer, i.e. over and on the paste layer covering the predetermined portions, and a light is projected onto the paste layer through the beam apertures of the mask; the irradiated portions of the paste layer being exactly equal to the predetermined portions on which the phosphor dots are to be coated.

The irradiated portions of the paste layer are hardened by a light, so that, by developing the paste layer, only the hardened portions of the paste layer having the predetermined shapes can remain on the predetermined portions of the dielectric layer.

Then, the remaining hardened paste layer is subjected to heat treatment of relatively low temperature (about 250°~450° C.). Consequently, all the organic materials contained in the paste layer are decomposed and removed from the paste layer.

Next, the powdered glass contained in the paste layer is fused by heating the paste layer at relatively high temperature (about 450°~550° C.). Thus the desired shaped phosphor dots or patterns adhere very firmly to the predetermined portions on the dielectric layer.

According to the present invention, not only a monochromatic display panel, but also a novel flat color display panel can be fabricated very easily.

That is to say, in fabricating the monochromatic display panel, the phosphor emitting only mono-color light is added to the paste materials and only one printing procedure and one light exposing procedure are employed.

On the other hand, in the case of fabricating a color display panel, it is necessary to provide three kinds of paste materials containing red-emitting phosphor, blue-emitting phosphor and green-emitting phosphor respectively, together with the photoresist material and the powdered glass.

First of all, the first paste layer containing the first phosphor (for example, the red-emitting phosphor) is coated on the desired areas of the dielectric layer by means of the said printing method. These areas cover at least the predetermined portions of the dielectric layer on which the phosphor dots of the first phosphor are formed, and are somewhat broader than the predetermined portions.

In the same way, the second paste layer containing the second phosphor (for example, the blue-emitting phosphor), and the third paste layer containing the third phosphor (for example, the green-emitting phosphor) are coated separately on the desired areas of the dielectric layer. These areas cover at least the predetermined portions of the dielectric layer on which the dots of the second and the third phosphors are to be formed respectively, and are somewhat broader than the predetermined portions.

Then, a light is projected onto the said predetermined portions of the first, the second and the third paste layers at the same time.

The ensuing steps are just the same as those described, in the case of fabricating the mono-color display panel. Consequently, in the present invention, though it is necessary to repeat the printing procedures three times, only one step is needed for every ensuing procedure, that is, exposure of light, development, removal of organic materials and fusing of the glass powder, for fabricating the color display panel.

Therefore it is apparent that the present invention is very advantageous compared with conventional printing or light exposing methods, in that the fabrication of a flat color display panel is very easy and very precisely shaped phosphor dots or patterns can be coated on the predetermined portions of the discharge spaces or elements very accurately.

In this specification, for convenience sake, cases are described where donut-shaped phosphor dots are provided. It is a matter of course that phosphor dots having a desired shape, e.g. elliptical, square, rectangular or hexagonal can be formed, if the shapes of the beam apertures of the mask are accordingly selected. The sizes or diameters of through holes and phosphor dots vary with the size of the flat display panel. However, diameters of through holes and phosphor dots are usually about 0.2 and 0.6 mm., respectively.

The practical content ranges of the phosphor, photoresist and glass powder in the paste are about 37~65%, 32~60% and 3.5~18% in weight respectively. Also, if necessary, some quantities of water can be added to said paste.

EXAMPLE 1

Referring to FIG. 1, a dielectric layer 2 of lead glass is coated on one surface of the insulating substrate 7 made of silicate glass plate. Then subsidiary discharge spaces 8 and through holes 10 are provided at predetermined positions on the dielectric layer 2. The display anodes provided under the dielectric layer 2 are partly exposed by the through holes 10.

Figure 2:
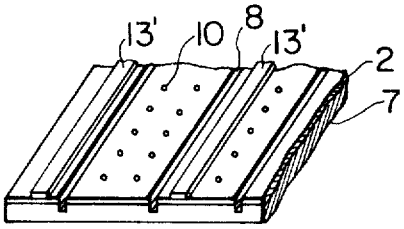

As shown in FIG. 2, the first paste layers 13' containing a red-emitting phosphor ($YVO_4$:Eu, or $Y_2O_3$ : EU), a photoresist material and glass powder are coated on said dielectric layer 2, by means of the printing method. The first paste layers 13' have a stripe-shape and are coated selectively to cover at least the corresponding through holes, so that the subsidiary display spaces 8 are not covered with the stripe-shape first paste layers 13'.

Figure 3:
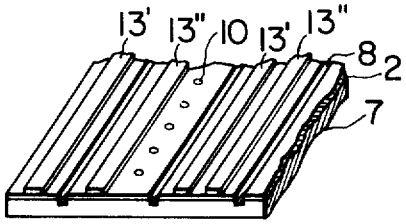
Figure 4:
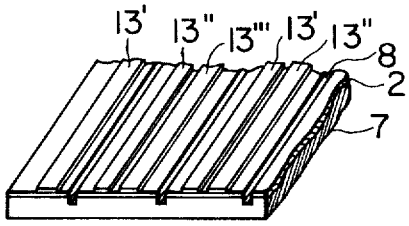

As shown in the FIGS. 3 and 4, the stripe-shape second paste layers 13'' containing the blue-emitting phosphor ($CaVO_4$ : Pb, or $Y_2SiO_5$ : Ce), and the third paste layers 13''' containing the green-emitting phosphor ($Zn_2SiO_4$ :Mn) are successively coated, in the same way as the first paste layers 13'.

Each paste layer 13', 13'', 13''' comprises 24 grams of phosphor, 4.8 grams of glass powder and 24 grams of photoresist material. A photoresist material designated as "KTFR" (trademark by Eastman Kodak Company) was employed in this composition.

A mask having beam apertures is placed closely to said paste layers 13', 13'', 13'''. Then through said beam apertures, a light from a high pressure mercury lamp is irradiated onto the predetermined portions of said paste layers 13', 13'', 13''' at the same time; in this manner the irradiated portions of the paste layers are hardened.

Figure 5:
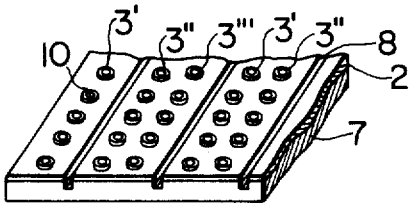

By developing these resulting paste layers in spray developing method with "KTFR developer", unirradiated portions of the paste layers are perfectly removed. Therefore, as shown in FIG. 5, only the hardened portions 3', 3'' and 3''', which have a very exact shape and precise positioning around the through holes 10 and positioned over the display anodes 10' remain.

Then, these remaining hardened portions of the paste layers 3', 3'', 3''' are heated to a temperature of about 450° C. for about 30 minutes. In this manner, the organic materials contained in the hardened portions, e.g. azido sensitizer and synthetic gum, are decomposed and are perfectly removed from the hardened portions.

Finally, by heating to a temperature of about 480° C. for about 30 minutes, the glass powder contained in the hardened portions 3', 3'', 3''' is fused, and the phosphor dots having a desired shape (in FIG. 5, donut-shaped phosphor dots are shown) are formed.

These phosphor dots not only have a very accurate shape, but also adhere to the desired portions of the dielectric layer 2, very fimrly and very exactly, and consequently are very suitable for a flat display panel.

EXAMPLE 2

The flat display panel phosphor dots are provided by using pastes specified by the following compositions 1 through 4, and by following the same procedures set forth in Example 1. Very excellent results were attained in each case.

| | |
|---|---|
| Composition 1 | |
| KTFR | 18 ~ 32 g. |
| powdered glass | 3 ~ 9 g. |
| phosphor | 15 ~ 32 g. |
| Composition 2 | |
| KMER | 15 ~ 28 g. |
| (trademark of Eastman Kodak Company for photoresist material) | |
| powdered glass | 3 ~ 9 g. |
| phosphor | 15 ~ 30 g. |
| Composition 3 | |
| KPR-4 | 15 ~ 28 g. |
| (trademark of Eastman Kodak Company for photoresist material) | |
| powdered glass | 3 ~ 9 g. |
| phosphor | 15 ~ 30 g. |
| Composition 4 | |
| polyvinyl pyrollidone | 2.5 ~ 4.0 g |
| Diazo Resin No. 4 type "L" | 0.1 ~ 0.6 g. |
| (trademark of Fairmount Company for a photoresist material) | |
| powdered glass | 3 ~ 9 g. |
| phosphor | 15 ~ 32 g. |
| water | 70 ~ 82 g. |

EXAMPLE 3

Figure 6:
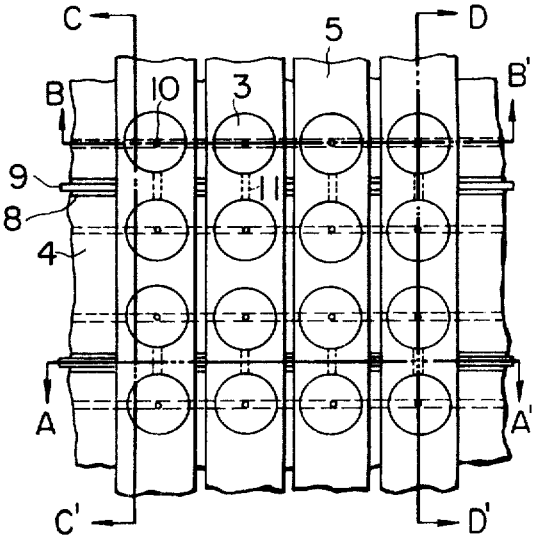
FIG. 6 is a fragmentary front view of one example of a flat display panel.
Figure 7A:
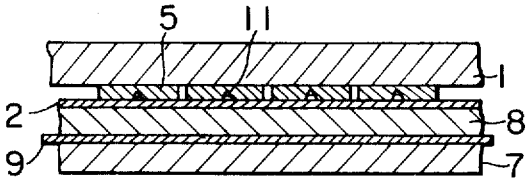
FIG. 7A is a sectional view taken along the line A—A′ of FIG. 6.
Figure 7B:
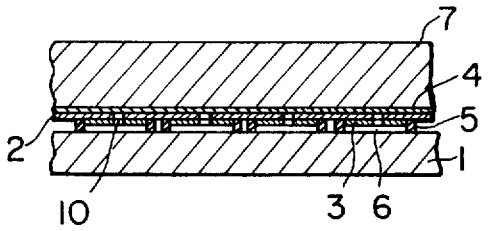
FIG. 7B is a sectional view taken along the line B—B′ of FIG. 6.
Figure 7C:
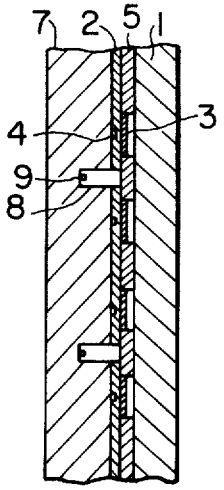
FIG. 7C is a sectional view taken along the line C—C′ of FIG. 6.
Figure 7D:
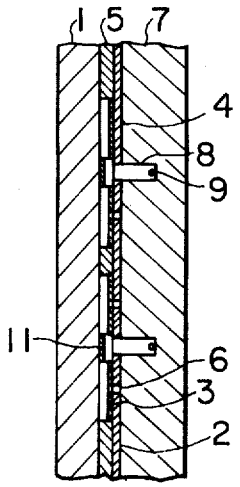
FIG. 7D is a sectional view taken along the line D—D′ of FIG. 6.

Referring now to FIG. 6, one example of the flat display panel apparatus having the phosphor dots provided by the present invention as shown. FIGS. 7A, 7B, 7C and 7D are sectional views taken along the line A—A', B—B', C—C' and D—D' FIG. 6 respectively.

In these drawings, reference numeral 1 designates a transparent insulating substrate of silicate glass, and a subsidiary anode 9 of nickel line is provided on the bottom of each subsidiary discharge space 8. An anode lead 4 of silver line is provided on the surface of the insulating layer 7, and a dielectric layer 2 of lead glass is coated to cover said transparent insulating layer 1 and said anode lead 4. Said anode lead 4 is partly exposed by the through holes 10 which are provided through the dielectric layer 2, and the exposed portions of said anode lead 4 acts as the display anode 10'.

The phosphor dot 3 is provided on the surface of the dielectric layer 2 and surrounds the through hole 10 leading to the display anode 10'. The cathode plate 5 crosses perpendicularly to the subsidiary discharge space 8. The display discharge space 6 is provided through the dielectric layer 2, and a display anode 10' is positioned at the center of the display discharge space 6. The coupling ditch 11 is provided on the cathode plate 5, and couples display discharge space 6 and the subsidiary discharge space 8.

All of the said spaces are charged with inert gas, e.g. Xenon, Neon, or Helium containing a small amount of gaseous mercury, and because the display panel apparatus has the structure described above, the display discharge occurs in the spaces between the cathode 5 and the display anode 10' and then the excitation of the phosphor dots 3 and light radiation follow.

What is claimed is:

1. A method of forming a flat display panel having phosphor dots comprising the steps of:

a. applying a paste layer containing a phosphor, photoresist material and powdered glass onto the areas of a dielectric layer by means of a printing procedure, said areas covering at least the predetermined portions of said dielectric layer on which the phosphor dots are to be formed, and being broader than said portions;

b. placing a mask having the beam apertures on the paste layer on said dielectric layer;

c. irradiating light onto said paste layer through said beam apertures of the mask to harden the areas of said paste layer coated on said predetermined portions of said dielectric layer;

d. developing said paste layer so as to remove the nonhardened areas of said paste layer;

e. heating the hardened portions of the paste layer at a first temperature of from 250° to 450° C. to decompose and thereby to remove organic materials contained in said paste layer;

f. then heating said paste layer at a second temperature higher than the first temperature to fuse said glass powder contained in said paste layer, said second temperature ranging from 450° to 550° C.

2. The method of claim 1, wherein the printing procedure of step (a) employs a silk screen to apply the paste layer to predetermined areas of the dielectric layer.

3. The method of claim 1, wherein said paste layer contains 37 to 65% by weight of the photoresist material.

4. The method of claim 3, wherein said paste layer contains 32 to 60% by weight of the phospher.

5. The method of claim 4, wherein said paste layer contains 3.5 to 18% by weight of powdered glass.

6. The method of claim 5, wherein said paste layer contains water.

7. A method of forming a flat color display panel having phosphor dots comprising the steps of:

a. applying a first paste layer containing a first coloremitting phosphor, photoresist material and glass powder, a second paste layer containing a second color-emitting phosphor, photoresist material and glass powder, and a third paste layer containing a third color-emitting phosphor, photoresist material and glass powder separately onto predetermined areas of the dielectric layer successively by means of a printing procedure, said areas covering at least the predetermined portions of said dielectric layer and being broader than said portions;

b. placing a mask having the beam apertures on the paste layers on said dielectric layer;

c. irradiating light onto said first, second and third paste layers through the beam aperture of said mask to harden the areas of said paste layers coated on said predetermined portions of said dielectric layer;

d. developing said paste layers to remove the nonhardened areas of said paste layers;

e. heating said hardened areas of the paste layers at a first temperature of from 250° to 450° C. to decompose and thereby to remove the organic materials contained in said paste layers;

f. then heating said paste layers at a second temperature higher than the first temperature to fuse said glass powder contained in said paste layers, said second temperature ranging from 450° to 550° C.

8. The method of claim 7, wherein the printing procedure of step (a) employs a silk screen to apply the paste layer to predetermined areas of the dielectric layer.

9. The method of claim 7, wherein said first, second and third paste layers each contains 37 to 65% by weight of the photoresist material.

10. The method of claim 7, wherein said first, second and third colored phosphors are red, blue and green phosphors respectively.

11. The method of claim 9, wherein said first, second and third paste layers each contains 32 to 60% by weight of the phosphor.

12. The method of claim 11, wherein said first, second and third paste layers each contains 3.5 to 18% by weight of glass powder.

13. The method of claim 12, wherein said first, second and third paste layers each contains water.

* * * * *